US008968159B2

(12) United States Patent
Johnson

(10) Patent No.: US 8,968,159 B2
(45) Date of Patent: Mar. 3, 2015

(54) FOLDING ELLIPTICAL EXERCISE MACHINE

(75) Inventor: Noel Johnson, Stoughton, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 430 days.

(21) Appl. No.: 13/539,496

(22) Filed: Jul. 2, 2012

(65) Prior Publication Data

US 2013/0310225 A1 Nov. 21, 2013

(51) Int. Cl.
*A63B 22/06* (2006.01)

(52) U.S. Cl.
USPC ..... 482/52

(58) Field of Classification Search
CPC ..... A63B 22/0664; A63B 22/001
USPC ..... 482/52, 51, 57, 62, 70, 908
See application file for complete search history.

(56) References Cited

U.S. PATENT DOCUMENTS

| | | | | |
|---|---|---|---|---|
| 7,946,962 | B2 * | 5/2011 | Long | 482/52 |
| 2008/0280733 | A1 * | 11/2008 | Dickie et al. | 482/52 |
| 2013/0143721 | A1 * | 6/2013 | Dalebout | 482/54 |

* cited by examiner

*Primary Examiner* — Loan H Thanh
*Assistant Examiner* — Rae Fischer

(57) ABSTRACT

A folding elliptical exercise machine includes a main frame, a guider frame coupled to the main frame for being moved between a use position and a storage position, a rotatable crank mechanism arranged on the main frame, two supporting members coupled between two crank units of the rotatable crank mechanism and two tracks of the guider frame, and two pedals coupled to the two supporting members. The engagement of the locking device is affected by the position of the guider frame. The locking device has a latch which can be located in an unlocked position where it is not interfering with the rotatable crank mechanism when the guider frame is oriented in the use position, or can be located in a locking position for stopping the rotatable crank mechanism from rotating when the guider frame is moved from the use position to the storage position.

14 Claims, 9 Drawing Sheets

FOLDING ELLIPTICAL EXERCISE MACHINE

RELATED APPLICATIONS

The application claims priority to Taiwan Application Serial Number 101117946, filed May 18, 2012, which is herein incorporated by reference.

BACKGROUND

1. Technical Field

The present disclosure relates to an indoor exercise machine. More particularly, the present disclosure relates to a folding elliptical exercise machine.

2. Description of Related Art

The applicant discloses a folding elliptical exercise apparatus as disclosed in U.S. Pat. No. 7,946,962. The footprint of the elliptical exercise apparatus is much more compact after folding. In addition, a user can quickly and conveniently operate the folding or unfolding procedures. With a traditional folding elliptical exercise apparatus, the linked elements such as crank mechanisms, foot pedals, and handle links are not locked while the elliptical exercise apparatus is folded. The linked elements may be moved by an external force or a shift of their centers of gravity, and this movement may occur randomly and in an uncontrolled manner, possibly during the folding process, the unfolding process, or while transporting the elliptical exercise apparatus. This uncontrolled and unintended motion is undesirable in an elliptical exercise apparatus.

U.S. Pat. Publication No. 2008/0280733 discloses another type of a folding elliptical exercise apparatus which has a mechanism for locking a crank unit while the elliptical exercise apparatus is oriented in a storage position. The user turns a locking mechanism which fastens a predetermined pin of the crank unit for locking a crank mechanism. However, the foregoing technique is not automatic, and requires an extra step for engaging the locking mechanism to lock the crank mechanism, so that the operation will be very inconvenient.

SUMMARY

According to one embodiment of the present invention, a folding elliptical exercise machine includes a main frame, a guider frame, a rotatable crank mechanism, two supporting members, two pedals and a locking device. The guider frame is pivotally coupled to the main frame for being moved between a use position and a storage position, and the guider frame has two tracks. The rotatable crank mechanism has a crank shaft, two crank units, a flywheel and a transmission mechanism. The crank shaft is pivotally arranged on the main frame. The two crank units are fixed on two ends of the crank shaft respectively. The flywheel is pivotally coupled to the main frame. The transmission mechanism is coupled to the crank units and the flywheel. Each of the two supporting members respectively has a rotating portion, a reciprocating portion and a supporting portion. The two rotating portions are pivotally coupled to the two crank units respectively, and move along a circular path about the crank shaft. The two reciprocating portions are carried by the two tracks respectively. The two reciprocating portions are movable back and forth along the two tracks respectively while the guider frame is oriented in the use position. The two pedals are respectively coupled to the two supporting portions of the two supporting members. The locking device is arranged between the guider frame and the rotatable crank mechanism, the position of the locking device is affected by the position of the guider frame, and the locking device has a latch having an unlocked position and a locking position. When the guider frame is oriented in the use position, the latch is set to the unlocked position so that it does not interfere with the rotation of the rotatable crank mechanism. When the guider frame is moved from the use position to the storage position, the latch set to the locking position to prevent a predetermined element of the rotatable crank mechanism from rotating.

According to another embodiment of the present invention, a folding elliptical exercise machine includes a main frame, a guider frame, a rotatable crank mechanism, two supporting members, two pedals and a locking device. The guider frame is pivotally coupled to the main frame for being moved between a use position and a storage position, and the guider frame has one or more guide tracks. The rotatable crank mechanism has a crank shaft, two crank units, a large pulley, a flywheel and a transmission mechanism. The crank shaft is pivotally arranged on the main frame. The two crank units are fixed on two ends of the crank shaft respectively, and rotation of the two crank units simultaneously rotates the two crank units and the large pulley about the crank shaft. The large pulley has two catches which are spaced 180 degrees apart from each other on the large pulley. The flywheel is pivotally coupled to the main frame. The transmission mechanism is coupled to the large pulley and the flywheel. The two supporting members are coupled to the respective crank unit so that each supporting member has a first portion, a second portion and a supporting portion. The two first portions are pivotally coupled to the two crank units respectively, and rotatable about the crank shaft. The two second portions are constrained by the one or more guide tracks respectively to move along a reciprocating path while the guider frame is oriented in the use position. The two pedals are respectively coupled to the two supporting portions of the two supporting members. The locking device is operatively coupled to the guider frame and the rotatable crank mechanism, the movement of the guider frame as the guider frame is pivotally moved with respect to the main frame engages and disengages the locking device. The locking device has a latch movable between an unlocked position and a locking position. The latch is retracted into an unlocked position when the guider frame is positioned in the use position. The latch is extended into a locking position when the guider frame is pivotally rotated away from the use position so that the latch will engage with one of the two catches on the large pulley when the large pulley is rotated into a position where one of the two catches aligns with the latch, thereby preventing rotation of the rotatable crank mechanism.

The locking device is configured to engage the lock between the large pulley and the main frame as the guider frame is pivotally rotated from the use position to the storage position. When the large pulley is locked so as to prevent it from rotating with respect to the main frame, the large pulley, the crank units, the supporting members and the pedals are prevented from engaging in any uncontrolled or unintended motion. The locking device is configured to disengage the lock between the large pulley and the main frame as the guider frame is pivotally rotated from the storage position back to the use position. When the large pulley is unlocked so as to allow it to freely rotate with respect to the main frame, the supporting members and the pedals are permitted to move in relationship to the guider frame.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details.

In other instances, well-known structures and devices are schematically depicted in order to simplify the drawings.

Figure 1:
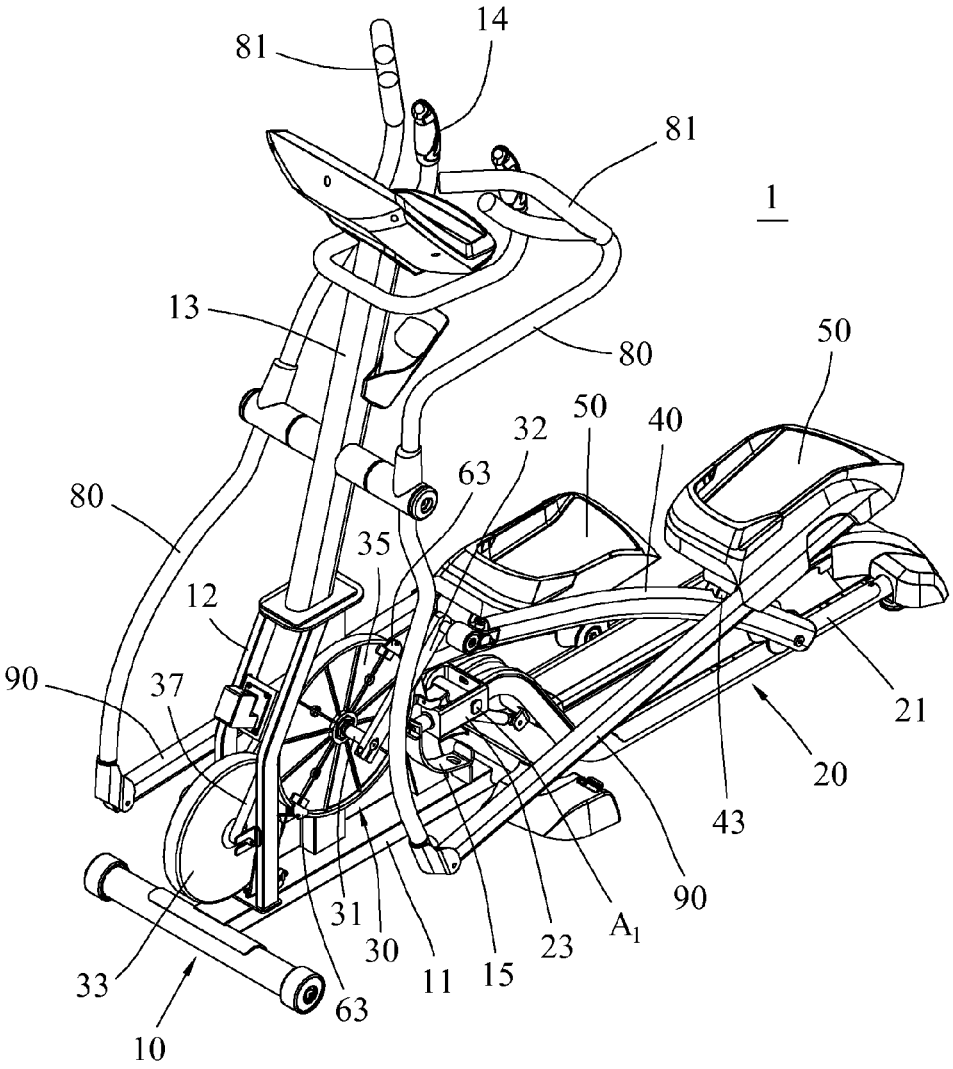
FIG. 1 and FIG. 2 are perspective views of a folding elliptical exercise machine which is oriented in a use position according to one embodiment of the present invention.
Figure 2:
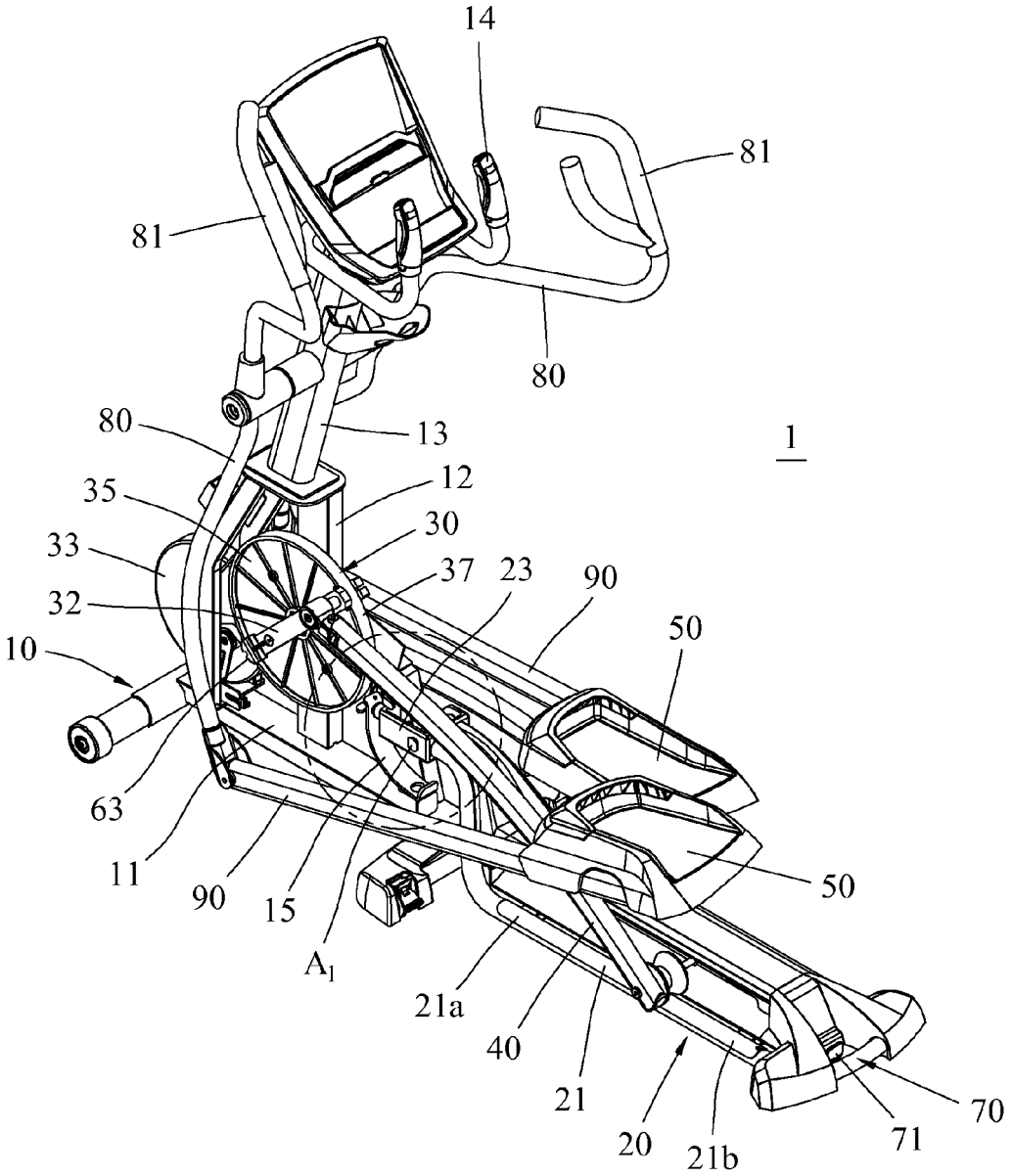
Figure 3:
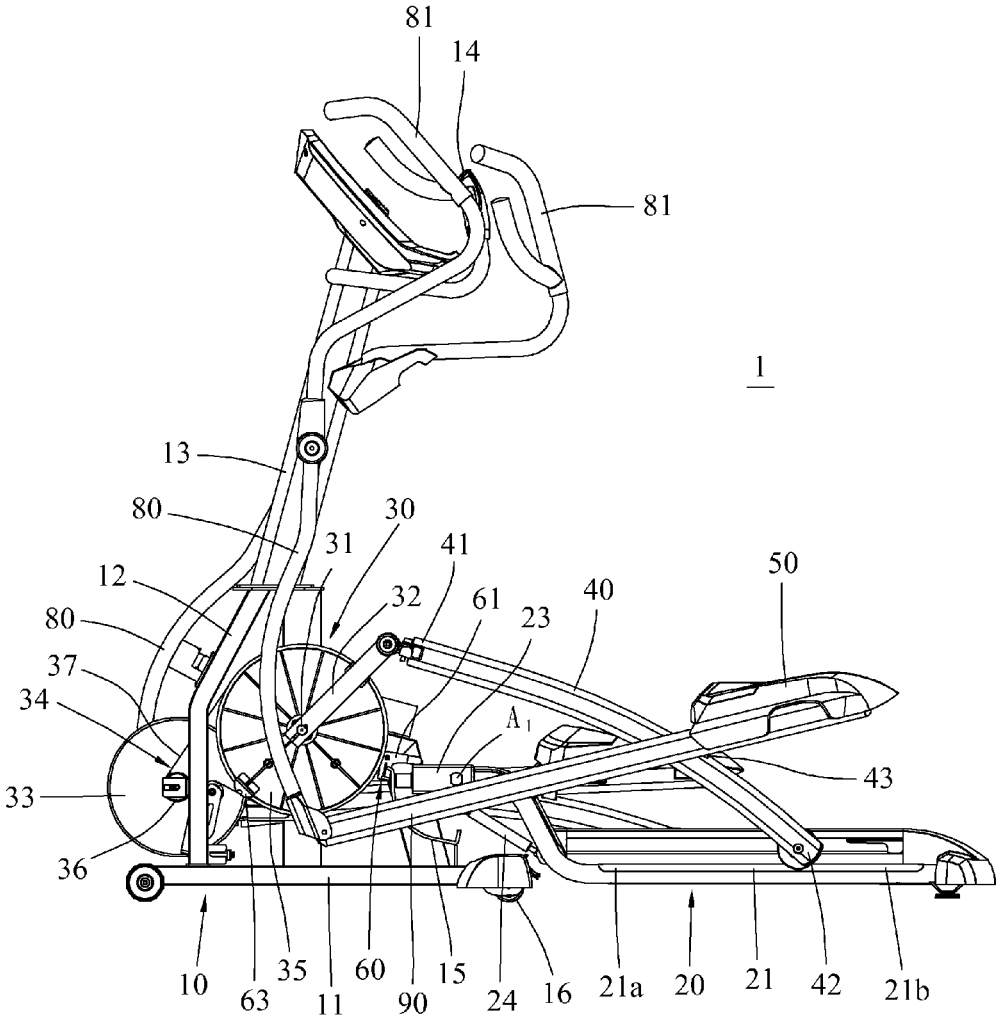
FIG. 3 is a lateral view of FIG. 2.

FIG. 1 and FIG. 2 are perspective views of a folding elliptical exercise machine which is oriented in a use position according to one embodiment of the present invention. FIG. 3 is a lateral view of FIG. 2. As shown in FIGS. 1-3, a folding elliptical exercise machine 1 includes a main frame 10, a guider frame 20, a rotatable crank mechanism 30, two supporting members 40, two pedals 50 and a locking device 60. The guider frame 20 is pivotally coupled to the main frame 10 for being moved between a use position and a storage position. The rotatable crank mechanism 30 is arranged on the main frame 10. One end of each of the two supporting members 40 are coupled to the rotatable crank mechanism 30, and the other ends are carried by the guider frame 20. One end of each of the two supporting members 40 is therefore constrained to move about a circular path, and the other end of each of the two supporting members 40 is therefore constrained by the guider frame 20 to move along a reciprocating path, so that these two motions are combined to form an elliptical-like closed path in between these two ends of each of the two supporting members 40. The two pedals 50 are coupled to the two supporting members 40 respectively for carrying the two respective feet of a user. When the folding elliptical exercise machine 1 is oriented in the storage position, the locking device 60 is used for locking the rotatable crank mechanism 30. Due to the two supporting members 40 being coupled to the rotatable crank mechanism 30, when the rotatable crank mechanism 30 is locked, the other elements such as the supporting members 40 also become correspondingly locked.

The main frame 10 is arranged on a floor. The present embodiment of the main frame 10 includes a base 11, a rack 12, a post 13 and a handgrip 14. The base 11 rests on a ground surface. The rack 12 is mounted on a top of the base 11. The post 13 is formed by a top portion of the rack 12. The handgrip 14 is arranged on a top portion of the post 13 for the user to grip while exercising. In addition, the present embodiment can be equipped with a control console on the top end of the post 13 as well.

Figure 4:
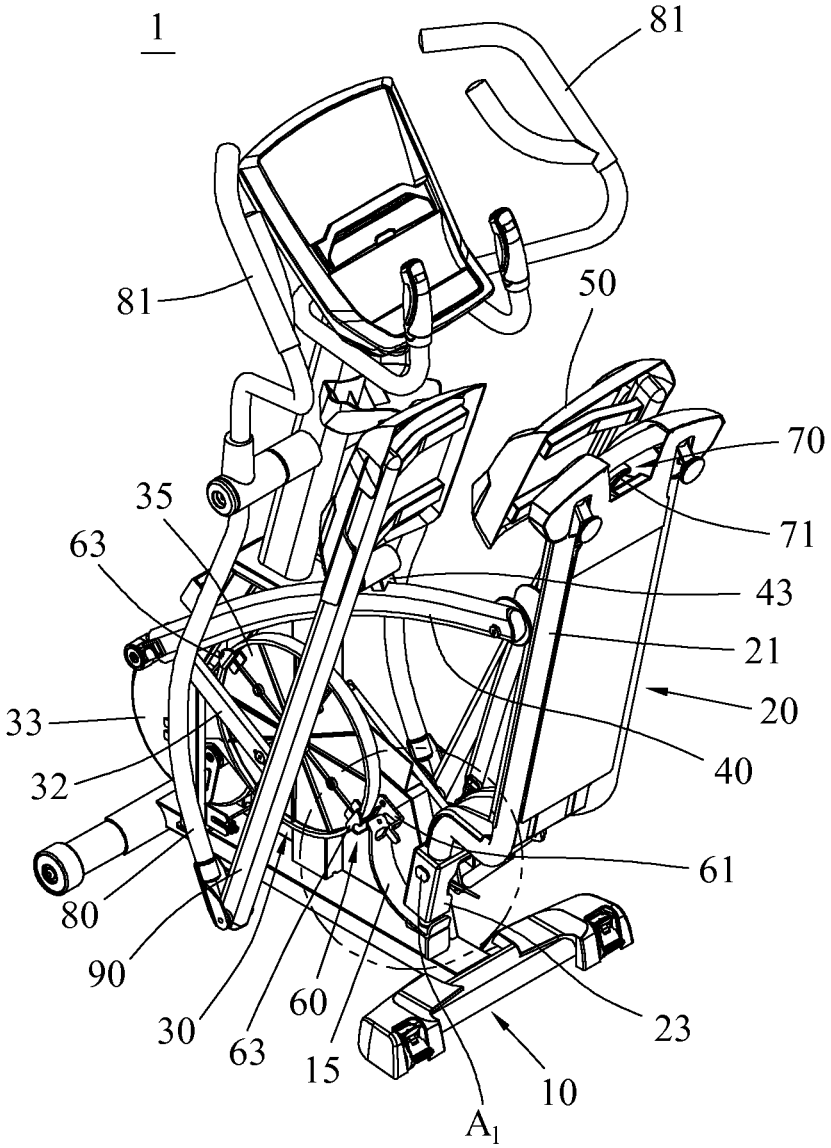
FIG. 4 is a perspective view of the folding elliptical exercise machine which is oriented in a storage position.
Figure 5:
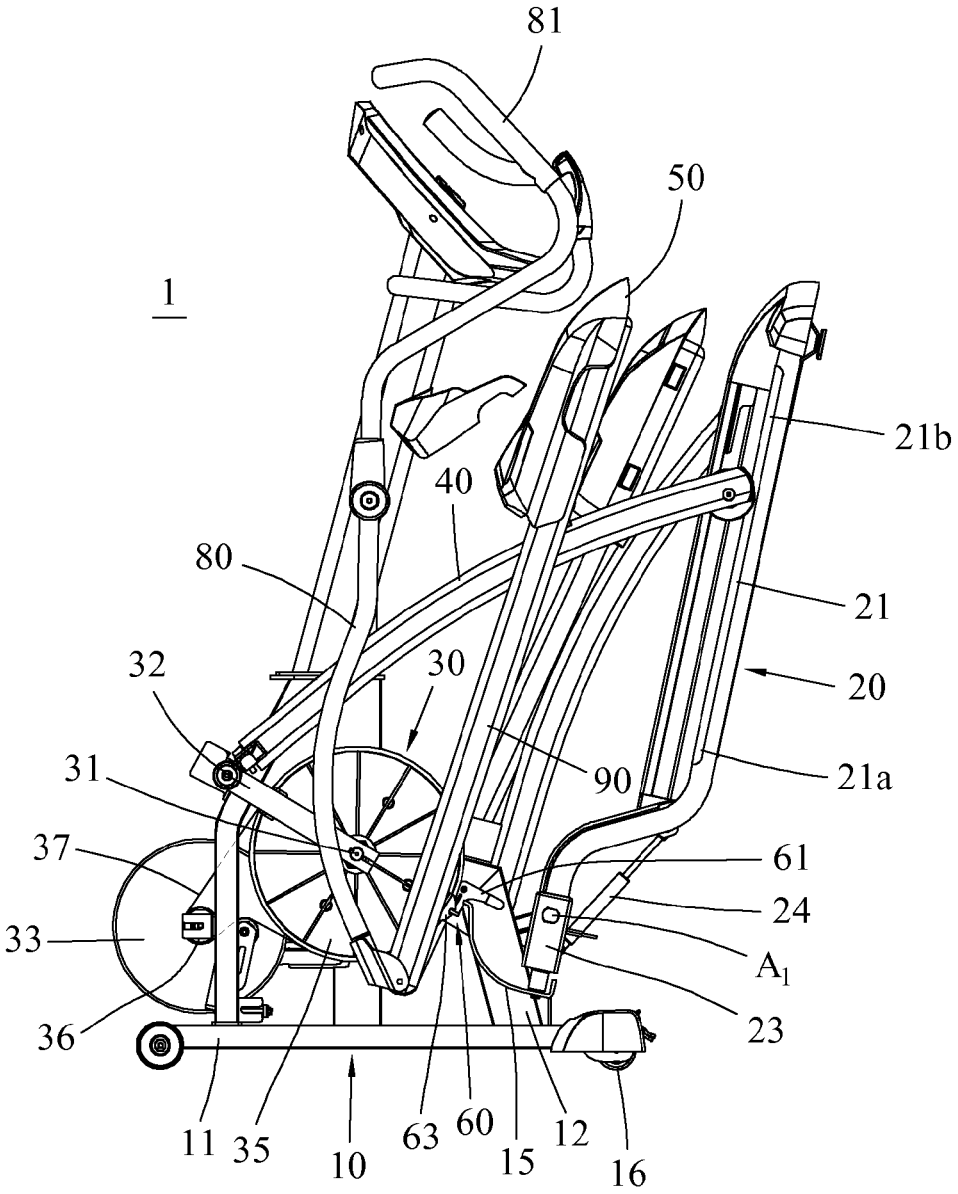
FIG. 5 is a lateral view of FIG. 4.

FIG. 4 is a perspective view of the folding elliptical exercise machine which is oriented in a storage position. FIG. 5 is a lateral view of FIG. 4. As shown in FIGS. 2-5, the guider frame 20 is pivotally coupled to the main frame 10 and has two tracks which are parallel. Each track 21 has a front end 21*a* and a rear end 21*b*. The front ends 21*a* of the two tracks extend to form an arm 23. A front end of the arm 23 is pivotally coupled to a rear end of the rack 12 via a guider shaft $A_1$ so that the guider frame 20 can be rotated in relation to the main frame 10 between a use position (shown in FIGS. 1-3) and a storage position (shown in FIGS. 4-6). In the embodiment shown, the angle between the use position and the storage position is about eighty degrees.

As shown in FIG. 3, pads of the guider frame 20 are rested on the ground surface while the guider frame 20 is oriented in the use position. The two tracks 21 are substantially parallel to the ground surface. As shown in FIG. 5, when the guider frame 20 is rotated up to be oriented in the storage position, an angle between the two tracks 21 and the ground surface is about eighty degrees.

The main frame 10 has a two-position ROM plate 15 which is fixed to the rack 12 and is located near the front end of the arm 23. The two-position ROM plate 15 is a curved plate with a substantially constant radius which takes the guider shaft $A_1$ as a center and has a first hole 15*a* and a second hole 15*b* (see FIGS. 7-8). The first hole 15*a* and the second hole 15*b* are separated by an angular distance of eighty degrees as measured from the guider shaft $A_1$. The angular distance and the angle between the use position and the storage position are the same.

The control methods and the operation of the guider frame 20 are similar to the embodiment disclosed in the U.S. Pat. No. 7,946,962. The guider frame 20 has a pull-pin locking mechanism 70 including a switch 71 which is arranged on a rear end of the guider frame 20, a pin 72 which is arranged on a front end of the arm 23, a pin spring (not shown) which is configured to extend the pin 72 outward and a steel cable 73 which is connected between the switch 71 and the pin 72. As configured, the steel cable 73 links the action of the switch 71 with the pin 72, so that as the user pulls the switch 71, the steel cable 73 causes the pin 72 to retract, and as the user ceases to pull the switch 71, the pin spring causes the pin 72 to extend outward again. When the pin 72 is extended, the pin 72 may engage with the first hole 15*a* or the second hole 15*b*, or it may slide along the two-position ROM plate 15. When the pin 72 is aligned with the first hole 15*a*, the guider frame 20 is oriented in the use position. When the pin 72 is aligned with the second hole 15*b*, the guider frame 20 is oriented in the storage position.

Looking again at FIG. 3, the rotatable crank mechanism 30 is arranged on the rack 12 of the main frame 10 and has a crank shaft 31, two crank units 32, a flywheel 33 and a transmission mechanism 34. The crank shaft 31 is pivotally arranged on the rack 12. The two crank units 32 are pivotally coupled to the rack 12 and are configured to rotate about the crank shaft 31. The flywheel 33 is pivotally coupled to the rack 12. The transmission mechanism 34 is coupled to the crank units 32 and the flywheel 33. The transmission mechanism 34 further includes a large pulley 35, a small pulley 36 and a pulley-belt 37. The large pulley 35 is coaxial to the crank shaft 31 and is fixed to the crank units 32. The large pulley 35 is also pivotally coupled to the rack 12 and configured to rotate with the crank shaft 31 and the crank units 32. The small pulley 36 is coaxial with the flywheel 33 and is fixed to the flywheel 33. The pulley-belt 37 is coupled to the large pulley 35 and the small pulley 36 so that the crank units 32 and the flywheel 33 rotate with each other at a predetermined speed ratio.

Each of the two supporting members 40 has a rotating portion 41, a reciprocating portion 42 and a supporting portion 43. A front end of each of the two supporting members 40 forms the rotating portion 41 which is pivotally coupled to the crank units 32 and is therefore constrained to move about the circular path. A rear end of each of the two supporting members 40 is pivotally connected to a roller wheel (not numbered) which is slidably supported by the corresponded track 21 and forms the reciprocating portion that can move back and forth along each of the two tracks. In the present embodiment, the supporting portion 43 of each of the two supporting members 40 is arranged between the rotating portion 41 and the reciprocating portion 42. The reciprocating portion 42 is configured to move along the reciprocating path along the track while the guider frame 20 is oriented in the use position and the rotating portion 41 moves along the circular path. At the same time, the supporting portion 43 moves along the elliptical-like closed path.

Each of the two pedals 50 is coupled to the corresponding supporting portion 43 of each of the two supporting members 40. The pedal 50 is guided by the supporting portion 43 so that the pedal 50 can move along the elliptical-like closed path.

In the present embodiment, a front end of each pedal 50 is pivotally coupled to the supporting portion 43. Moreover, the present embodiment further includes two handle links 80 and two control links 90. The two handle links 80 are pivotally coupled to the left and right side of the post 13 respectively. Each of the two handle links 80 has a bottom end and a top end. The top end is formed as a handle 81, and can be swung forth and back during exercise. A rear end of each of the two control links 90 is fixed to the outside of each of the two pedals 50 respectively, and a front end of each of the two control links 90 is pivotally coupled to the bottom end of each of the two handle links 80 respectively. In this embodiment, as the crank units 32 rotate through a full rotation, the supporting portion 43 of each supporting member 40 moves through an elliptical-like closed path, a front end of each pedal 50 moves through an elliptical-like closed path, a rear end of each pedal 50 moves up and down relative to the front end, and each handle link 80 pivots relative to the post 13.

It is worthy to note that the linkage relationship among the supporting members 40, the pedals 50 and the control links 90 can be modified without changing the basic function of the folding elliptical exercise machine 1. For instance, the linkage relationship can be changed as disclosed in the U.S. Pat. No. 5,540,637. That is, each of the two control links is directly pivotally connected to each of the two supporting members and each pedal is directly connected to a rear portion of the respective control link. In this configuration, each pedal would be indirectly pivotally coupled to the respective supporting member, and each pedal would still regularly change the angle relative to the corresponding supporting member during exercise. Another possible embodiment may provide the user only a function of leg exercising, i.e. the possible embodiment does not have the handle links 80 and the control links 90. These and other embodiments would be allowed without changing the scope of this patent.

The elliptical exercise machine 1 is configured to be folded up into the storage position as shown in FIG. 4 and FIG. 5, when the elliptical exercise machine 1 is not in use. Generally speaking, the user stands behind the elliptical exercise machine 1 and triggers the switch 71 to retract the pin 72 out of engagement with the first hole 15*a* in the two-position ROM plate 15. This allows the guider frame 20 to be freely rotated about the guider shaft $A_1$. During the folding process, the pin 72 of the pull-pin locking mechanism 70 may slide along the inside face of the two-position ROM plate 15. As the guider frame 20 is rotated up into the storage position, the pin spring will cause the pin 72 to engage with the second hole 15*b* to lock the guider frame 20 into the storage position.

Conversely, the user can unfold the elliptical exercise machine 1 into the use position by unlocking the guider frame 20. The user triggers the switch 71 to retract the pin 72 out of engagement with the second hole 15*b* while lowering the guider frame 20 into the use position. Once the guider frame 20 rests on the ground surface, the pin 72 will engage with the first hole 15*a* to lock the guider frame 20 in the use position.

Additionally, there is a gas spring 24 interconnected between a front end of the guider frame 20 and the main frame 10. The gas spring 24 can assist the user to lift up the guider frame 20 while folding up into the storage position as well as slow the descending speed to reduce the downward force while folding down into the use position.

Figure 6:
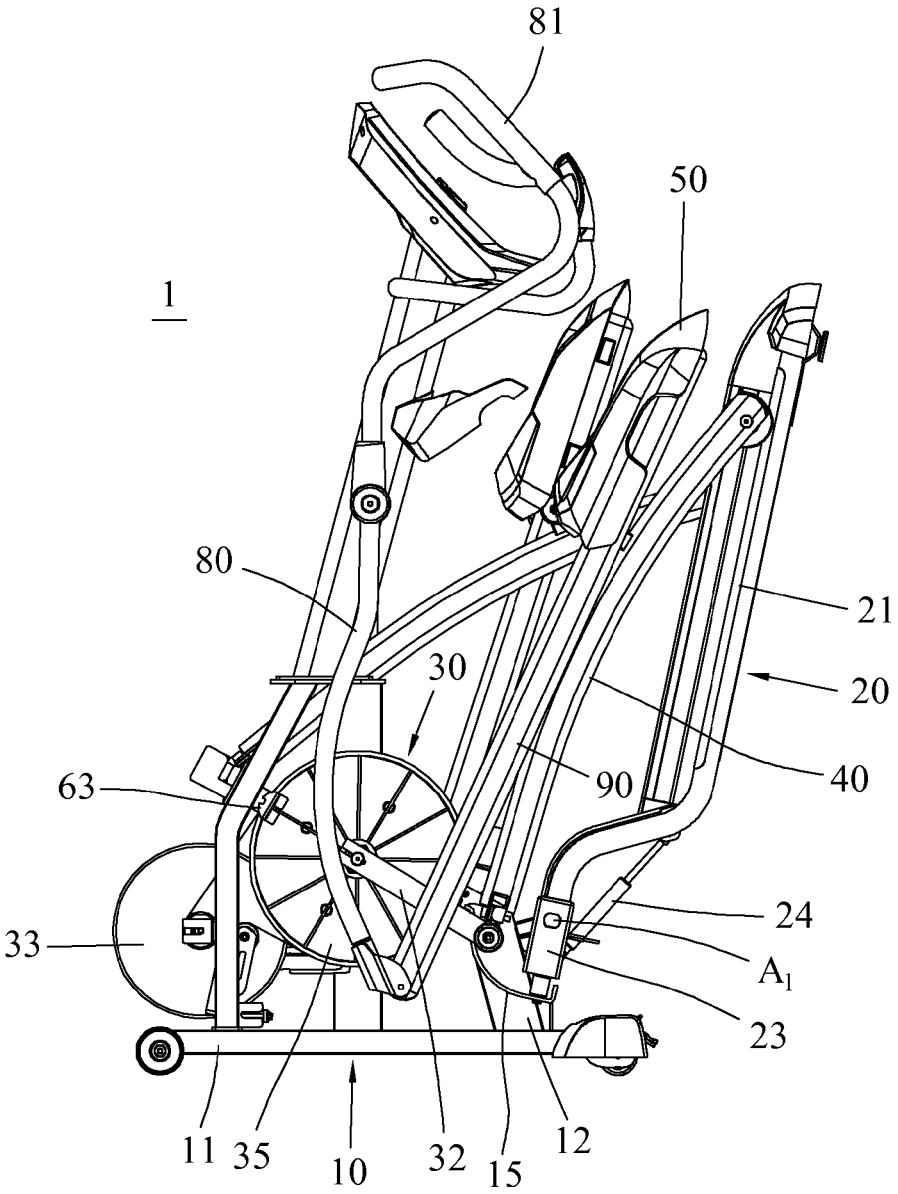
FIG. 6 is also a lateral view of the folding elliptical exercise machine which is oriented in the storage position, but with the relative position of various elements opposite to that shown in FIG. 5.

After the elliptical exercise machine 1 is folded up into the storage position, the present embodiment is configured to position the various linked elements (supporting members 40, pedals 50, handle links 80, handles 81 and control links 90) in either the configuration as shown in FIG. 5 or the opposite configuration as shown in FIG. 6, even though the user does not use the locking device 60. With regard to the movement of the various linked elements of the elliptical exercise machine 1 as they move from the use position to the storage position, the reader can refer to the specification of U.S. Pat. No. 7,946,962.

During the folding process, the linked elements are affected by many variables: the last stopped position of the linked elements, the center of gravity of the linked elements, forces applied by the user to the guider frame, and others. Due to the geometry of the linked elements, the position of right and left elements will be opposite to each other. Whatever the displacement process, the elliptical exercise machine 1 will always naturally tend to balance as shown in FIG. 5 or FIG. 6 when it is positioned in the storage position. In this balanced state, the handle links 80 are substantially aligned from a lateral view.

Referring to FIGS. 2-5, the locking device 60 is interconnected between the guider frame 20 and the rotatable crank mechanism 30. The position of the locking device 60 is affected by the position of the guider frame 20. The locking device 60 has a spring-loaded latch 61 which is arranged on the rack 12 and can be moved between a locking position and an unlocked position. An elastic member 62 is interconnected between the rack 12 and the spring-loaded latch 61. In the present embodiment, the elastic member 62 is a tension spring for providing a restoring force to bias the spring-loaded latch 61 to the locking position.

Figure 7:
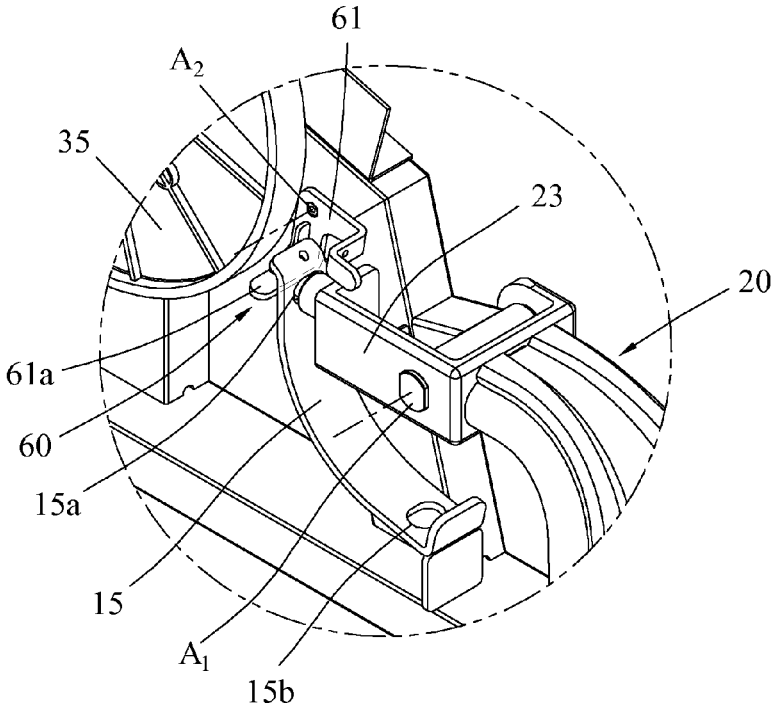
FIG. 7 is a detail view of FIG. 2.
Figure 8:
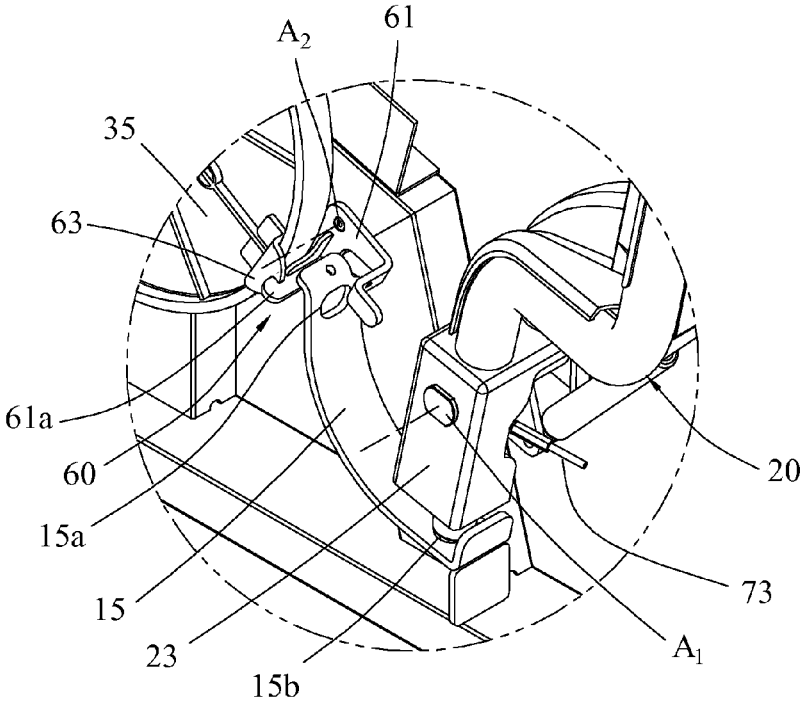
FIG. 8 is a detail view of FIG. 4.

FIG. 7 is a detail view of FIG. 2. FIG. 8 is a detail view of FIG. 4. As shown in FIG. 7 and FIG. 8, the spring-loaded latch 61 has a hook 61*a* for stopping the large pulley 35 of the rotatable crank mechanism 30. The present embodiment of the large pulley 35 has two catch portions 63 spaced one hundred and eighty degrees apart from each other on the large pulley 35. The locations of these two catches cause the crank units 32 to lock into one of two predetermined locations when the spring-loaded latch 61 engages the one of the two catches.

Figure 9A:
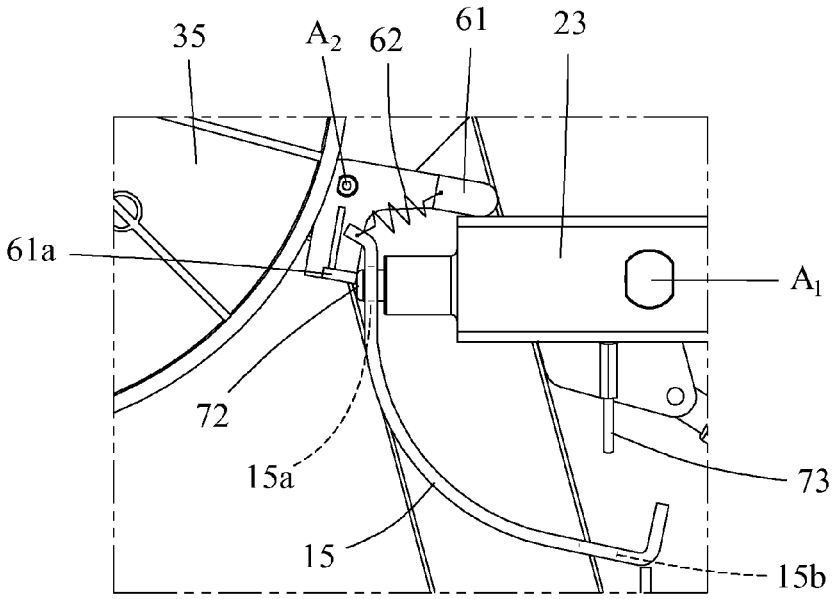
FIG. 9A to FIG. 9D are schematic movement diagrams of a locking device while the folding elliptical exercise machine is moved from the use position to the storage position.
Figure 9B:
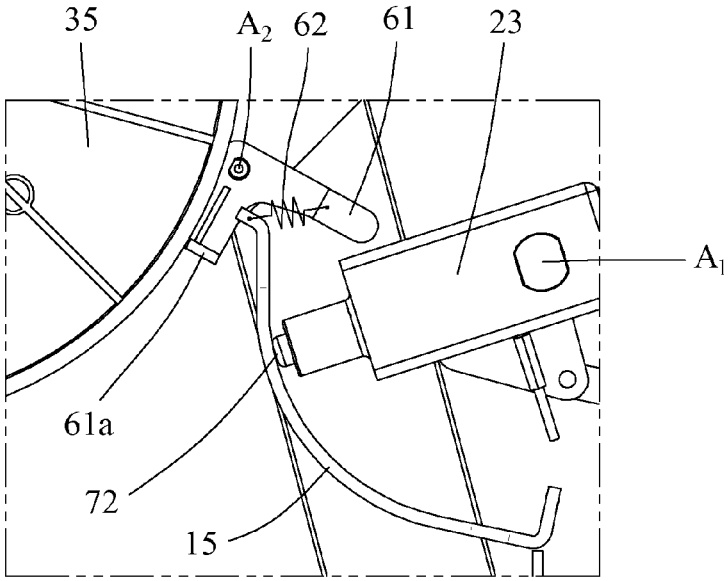
Figure 9C:
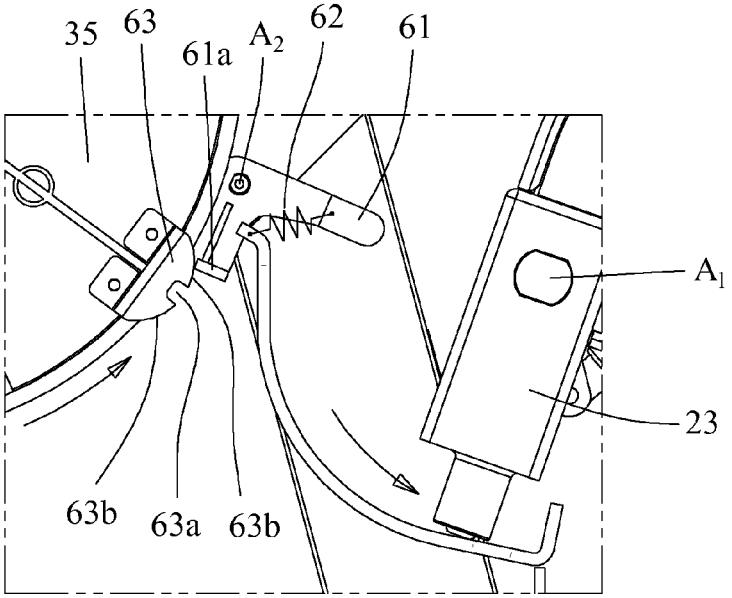
Figure 9D:
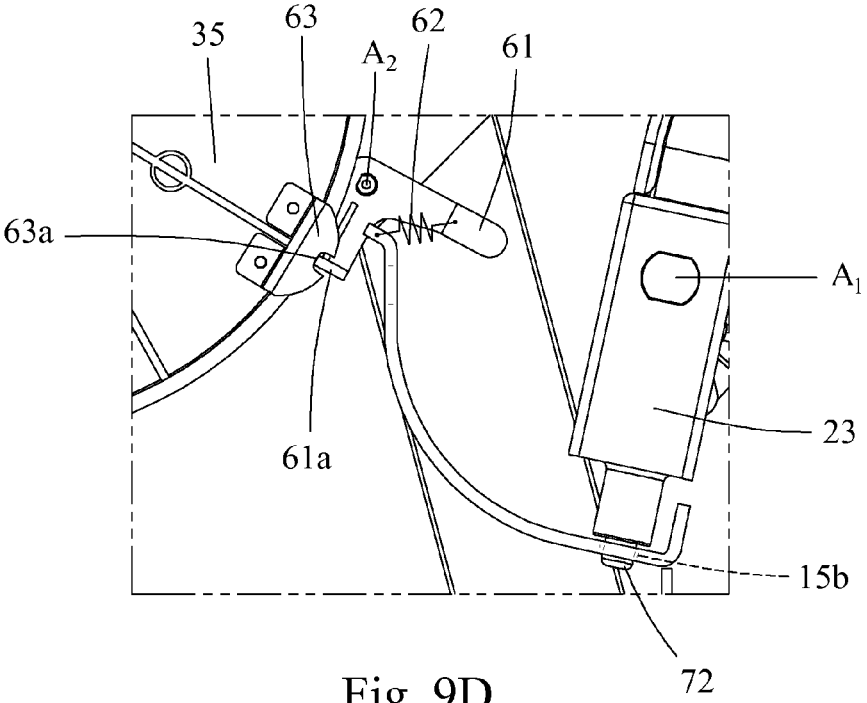

FIG. 9A to FIG. 9D are schematic movement diagrams of a locking device while the folding elliptical exercise machine is moved from the use position to the storage position. Referring to FIG. 9C and FIG. 9D, each of the two catch portions 63 has a notch 63*a* and two curved chamfers 63*b* which are positioned on either side of the notch 63*a*. The notch 63*a* and the two curved chamfers 63*b* all protrude past the outer edge of the large pulley 35. Each of the two catch portions 63 are positioned on the large pulley 35 in such a way that one or the other of the two catch portions 63 will be aligned with the hook 61*a* of the spring-loaded latch 61 when the elliptical exercise machine 1 is folded up into one of the two balanced storage positions as shown in FIG. 5 and FIG. 6.

As shown in FIG. 7 and FIG. 9A, when the guider frame 20 is oriented in the use position, the front top of the arm 23 is in contact with the spring-loaded latch 61, thereby rotating the spring-loaded latch 61 counter-clockwise about a hinge shaft $A_2$. The spring-loaded latch 61 is oriented in the unlocked position, and does not interfere with the large pulley 35 or either of the catch portions 63.

Referring to FIG. 9B, when the user triggers the switch 71 to retract the pin 72 out of engagement with the first hole 15*a* and rotates the guider frame 20 up, the arm 23 loses contact with the spring-loaded latch 61 so that the elastic member 62 provides the restoring force to bias the spring-loaded latch 61 from the unlocked position to the locking position. If the catch portion 63 of the large pulley 35 is not aligned with the spring-loaded latch 61, the hook 61*a* of the spring-loaded latch 61 will approach or slightly touch the surface of the pulley-belt 37 of the large pulley 35 and the rotatable crank mechanism 30 can still rotate. In other words, the spring loaded-latch 61 may be in the locking position, but if one of the two catch portions 63 is not aligned with the spring-loaded latch 61, then the rotatable crank mechanism 30 is not yet locked in place by the spring-loaded latch 61.

Referring to FIG. 9C and FIG. 9D, during the folding process, the pin 72 may slide along the inside face of the two-position ROM plate 15. Whether or not the pin 72 engages the second hole 15*b* to lock the guider frame 20 into the storage position, the arm 23 has lost contact with the spring-loaded latch 61, and the spring-loaded latch 61 is oriented in the locking position. As the larger pulley 35 rotates to a position which nearly aligns the catch portion 63 with the spring-loaded latch 61, the curved chamfer 63*b* of the catch portion 63 first reaches the hook 61*a* of the spring-loaded latch 61. Under the guidance and the contact with the curved chamfer 63*b*, the spring-loaded latch 61 will turn counter-clockwise slightly. The catch portion 63 keeps moving until the hook 61*a* slides along the curved chamfer 63*b* and slips into the notch 63*a*, then firmly locks the large pulley 35 into place relative to the spring-loaded latch 61. Almost at the same time, the pin 72 engages with the second hole 15*b* to lock the guider frame 20 into the storage position.

The foregoing locking process is the usual condition of the folding process of the elliptical exercise machine 1. However, there is another possibility that the guider frame 20 is already oriented and locked in the storage position, but the catch portion 63 of the large pulley 35 is not yet aligned with the spring-loaded latch 61. In other words, it is possible that the guider frame 20 may be locked in the upright storage position while the rotatable crank mechanism 30 is still free to rotate. In this situation, the user may move the handle link 80 to apply a rotational load to the large pulley 35, causing it to rotate slightly. This rotation of the large pulley 35 causes one of the two catch portions 63 to be repositioned until it aligns with the hook 61*a* of the spring-loaded latch 61, causing the spring-loaded latch 61 to engage with the notch 63*a* of the catch portion 63. Again, the final outcome is that the guider frame 20 is locked into the upright storage position and the rotatable crank mechanism 30 is locked into place relative to the spring-loaded latch 61.

Conversely, it is possible that if one of the catch portions 63 is aligned with the spring-loaded latch 61 before the elliptical exercise machine 1 is folded up into the storage position, the spring-loaded latch 61 will lock the rotatable crank mechanism 30 as soon as the guider frame 20 leaves the use position. In this state, even though the rotatable crank mechanism 30 cannot be rotated, the guider frame 20 can still be rotated up into the storage position. As the guider frame 20 is rotated up, the supporting members 40 are gradually moved vertical until the guider frame 20 is locked into the storage position as shown in FIG. 5 or FIG. 6. Again, the final outcome is that the guider frame 20 is locked into the upright storage position and the rotatable crank mechanism 30 is locked into place relative to the spring-loaded latch 61.

When the user wants to unfold the elliptical exercise machine 1, the user triggers the switch 71 to retract the pin 72 out of engagement with the second hole 15*b* while lowering the guider frame 20 into the use position. The rotatable crank mechanism 30 will remain locked in place until the guider frame 20 is rotated almost all the way back down into the use position. The spring-loaded latch 61 is not affected by any other force until the front end of the arm 23 comes into contact with the spring-loaded latch 61, so the hook 61*a* of the spring-loaded latch 61 will continue to engage with the notch 63*a* until it is disengaged by contact with the arm 23. During the unfolding process, the pin 72 slides along the inside of the two-position ROM plate 15 from the second hole 15*b* until it almost reaches the first hole 15*a*. During this time, the hook 61*a* of the spring-loaded latch 61 is engaging with the notch 63*a* as well. In other words, during the time the guider frame 20 is rotated down from the storage position to the use position, the large pulley 35 is also cannot rotate. When the guider frame 20 is near to the use position, the front end of the arm 23 will first contact with the spring-loaded latch 61 to turn the spring-loaded latch 61 counter-clockwise to the unlocked position. As a result, the hook 61*a* of the spring-loaded latch 61 disengages with the notch 63*a* of the catch portions 63 and the large pulley 35 can be rotated again.

The present embodiment makes the ease of use of operation of the equipment the primary consideration. If the large pulley 35 were to be free to rotate during the unfolding process, the user possibly would not be able to control the displacement of those linked elements during the folding or unfolding operations. The present embodiment of the spring-loaded latch 61 automatically disengages the hook 61*a* from the notch 63*a* of the catch portions 63 just as the guider frame 20 is exactly oriented in the use position.

It is worthy to note that the position of the spring-loaded latch 61 in the present embodiment is chosen to be the nearest place to the large pulley 35 where it can be engaged directly by the guider frame 20. Nevertheless, this position is not the only choice. According to the previous descriptions, the balanced storage position of the elliptical exercise machine 1 will be as shown as FIG. 5 or FIG. 6. In another embodiment, the position of the catch portions 63 could remain unchanged, but the spring-loaded latch 61 might be located on a front side of the large pulley 35, one hundred and eighty degrees relative to the original position, and the spring-loaded latch 61 still can lock the large pulley 35. The guider frame 20 as it is described would not be able to engage the spring-loaded latch 61 directly, but might need to use other elements like steel cable (the method is similar to the pull-pin locking mechanism 70). Additionally, the efficacy of this embodiment is tantamount to the previously cited embodiment. Changing the positions of the two catch portions 63 is also possible so that the designer can change the position of the spring-loaded latch 61 to the top end and bottom end of the large pulley 35 or any other desired positions. One characteristic of the present invention is that the locking device 60 can lock or unlock the rotatable crank mechanism 30 automatically as the guider frame is repositioned from the use position to the storage position or from the storage position to the use position, respectively. For this reason, the position of the spring-loaded latch 61 in the foregoing embodiment is merely one example.

It should also be noted that another characteristic of the present invention is locking the rotatable crank mechanism 30 by the locking device 60, and the present embodiment only describes a device where the locking device 60 locks the large pulley 35. Because the motion/rotation of the rotatable crank mechanism 30, the crank units 32, the flywheel 33, the large pulley 35, the small pulley 36, and the pulley-belt 37 are all interrelated, the locking device 60 locks other elements of the rotatable crank mechanism 30, and as such, locking any of these interrelated components would have the same effect and would not be departing from the spirit of the present invention.

Furthermore, the transmission mechanism 34 of the rotatable crank mechanism 30 for interconnecting between the crank units 32 and the flywheel 33 is "the first drive", but the transmission mechanism 34 of the present invention also may include "the secondary drive" that is using one belt to interconnect between a crank unit and a secondary driving shaft, then using another belt to interconnect between the secondary driving shaft and a flywheel. If using "the secondary drive", the locking device can lock a medial pulley which is arranged on the secondary driving shaft as well.

More particularly, when the folding exercise machine 1 is folded up into its storage position as shown in FIG. 5 or FIG. 6, the two handle links 80 are substantially aligned. The user can grip both handles 81 which are symmetrical to easily move the folding exercise machine 1 by a roller 16 which is arranged on the base 11. Furthermore, the guider frame is partially held in the storage position by the force of the gas spring 24, the guider frame 20 is locked in the upright storage position by the pull-pin locking mechanism 70, and the rotatable crank mechanism 30 is locked by the locking device 60, so the folding exercise machine 1 is quite stable in the storage position. Therefore, the user not only can concentrate on moving the folding exercise machine 1, but need not concern themselves about whether elements will start moving during the transportation of the unit, or to worry about unbalanced torque as the result of moving elements during transportation.

Another embodiment involves using a high friction coefficient substance as a spring-loaded latch 61. When the guider frame 20 is repositioned from the use position to the storage position, the high friction coefficient substance can press on the large pulley 35 and cause the friction to stop the rotation of the large pulley 35. This method also can achieve the purpose of stopping the large pulley 35, thereby preventing rotation of the rotatable crank mechanism 30 when the guider frame is oriented in the storage position.

According to the aforementioned embodiments, the user can lock or unlock the rotatable crank mechanism 30 automatically while the elliptical exercise machine 1 is folded or unfold without requiring an extra step for locking or unlocking, so that the operation will be very convenient. In addition, the folded elliptical exercise machine 1 is very stable for transportation when the rotatable crank mechanism 30 is locked. Moreover, the aligned handle links 80 and handles 81 can further aid in the convenience of transporting the elliptical exercise machine 1 when it is folded up into the storage position.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A folding elliptical exercise machine, comprising:

a main frame;

a guider frame pivotally coupled to the main frame for being moved between a use position and a storage position, and the guider frame having two tracks;

a rotatable crank mechanism having a crank shaft, two crank units, a flywheel and a transmission mechanism; the crank shaft pivotally arranged on the main frame; the two crank units fixed on two ends of the crank shaft respectively; the flywheel pivotally coupled to the main frame; the transmission mechanism coupled to the crank units and the flywheel;

two supporting members respectively having a rotating portion, a reciprocating portion and a supporting portion; the two rotating portions pivotally coupled to the two crank units respectively, and moving along a circular path about the crank shaft; the two reciprocating portions carried by the two tracks respectively; the two reciprocating portions moving back and forth along the two tracks respectively while the guider frame is oriented in the use position;

two pedals respectively coupled to the two supporting portions of the two supporting members; and a locking device arranged between the guider frame and the rotatable crank mechanism, the position of the locking device affected by the position of the guider frame, the locking device having a latch having an unlocked position and a locking position; the latch corresponding to locate at the unlocked position and not interfering with the rotation of the rotatable crank mechanism when the guider frame is in the use position; the latch corresponding to locate at the locking position for preventing a predetermined element of the rotatable crank mechanism from rotating when the guider frame is not in the use position.

2. The folding elliptical exercise machine of claim 1, further comprising two handle links and two control links, the two handle links which are pivotally coupled to the main frame having a top end and a bottom end, one end of the two control links respectively fixed on the two pedals, and the other end of the two control links respectively and pivotally coupled to the bottom end of the two handle links; the two handle links being substantially aligned from a lateral view of the folding exercise machine while the guider frame is oriented in the storage position and the rotatable crank mechanism is locked by the locking device.

3. The folding elliptical exercise machine of claim 2, wherein the predetermined element of the rotatable crank mechanism has two catch portions which are 180 degrees symmetrically arranged about a center shaft; the latch interfering with one of the two catch portions while the guider frame is oriented in the storage position and the latch is oriented in the locking position.

4. The folding elliptical exercise machine of claim 1, the rotatable crank mechanism further comprising at least two pulleys and at least one pulley-belt, and the predetermined element of the rotatable crank mechanism is one of the pulleys.

5. The folding elliptical exercise machine of claim 1, wherein the predetermined element of the rotatable crank mechanism is the flywheel.

6. The folding elliptical exercise machine of claim 1, wherein the latch is pivotally coupled to the main frame, and the locking device further comprises a elastic member arranged between the main frame and the latch, the latch biased toward the locking position by the elastic member when the guider frame is not oriented in the use position; and the latch disengaged from the locking position to an unlocked position when the guider frame is oriented in the use position.

7. The folding elliptical exercise machine of claim 6, wherein the latch moves to the locking position substantially simultaneously as the guider frame leaves the use position and prior to reaching the storage position; and wherein the latch only returns to the unlocked position as the guider frame is substantially returned to the use position.

8. The folding elliptical exercise machine of claim 1, wherein the latch of the locking device has a hook, and the predetermined element of the rotatable crank mechanism has at least one catch portion which is corresponding to the hook, each catch portion has a notch configured to engage the hook and two curved chamfers which are positioned on either side of the notch.

9. The folding elliptical exercise machine of claim 1, wherein the latch interferes with the predetermined element of the rotatable crank mechanism by using friction to prevent the predetermined element from rotating while the guider frame is oriented in the storage position and the latch of the locking device is oriented in the locking position.

10. A folding elliptical exercise machine, comprising:

a main frame;

a guider frame pivotally coupled to the main frame for being moved between a use position and a storage position, the guider frame having one or more guide tracks;

a rotatable crank mechanism having a crank shaft, two crank units, a large pulley, a flywheel and a transmission mechanism; the crank shaft pivotally arranged on the main frame; the two crank units fixed on two ends of the crank shaft respectively, and rotation of the two crank units rotating the two crank units and the large pulley about the crank shaft; the large pulley having two catches spaced 180 degrees apart from each other on the large pulley; the flywheel pivotally coupled to the main frame; the transmission mechanism coupled to the large pulley and the flywheel;

two supporting members coupled to the respective crank unit, each supporting member having a first portion, a second portion and a supporting portion; the two first portions pivotally coupled to the two crank units respectively and rotatable about the crank shaft; the two second portions constrained by the one or more guide tracks respectively to move along a reciprocating path while the guider frame is oriented in the use position;

two pedals respectively coupled to the two supporting portions of the two supporting members; and a locking device operatively coupled to the guider frame and the rotatable crank mechanism, the movement of the guider frame as the guider frame pivotally moves with respect to the main frame engaging and disengaging the locking device, the locking device having a latch movable between an unlocked position and a locking position; the latch retracted into an unlocked position when the guider frame is positioned in the use position; the latch extended into a locking position when the guider frame is pivotally rotated away from the use position so that the latch engages with one of the two catches on the large pulley when the large pulley is rotated into a position where one of the two catches aligns with the latch, thereby preventing rotation of the rotatable crank mechanism.

11. The folding elliptical exercise machine of claim 10, further comprising two handle links and two control links, the two handle links which are pivotally coupled to the main frame having a top end and a bottom end, one end of the two control links respectively fixed on the two pedals, and the other end of the two control links respectively and pivotally coupled to the bottom end of the two handle links; the two handle links being substantially aligned from a lateral view of the folding exercise machine while the guider frame is oriented in the storage position and the rotatable crank mechanism is prevented from rotating by the locking device.

12. The folding elliptical exercise machine of claim 10, wherein the latch is pivotally coupled to the main frame, and the locking device further comprises a elastic member arranged between the main frame and the latch, the latch biased toward the locking position by the elastic member when the guider frame is not oriented in the use position; and the latch disengaged from the locking position to an unlocked position when the guider frame is oriented in the use position.

13. The folding elliptical exercise machine of claim 12, wherein the latch moves to the locking position substantially simultaneously as the guider frame leaves the use position and prior to reaching the storage position; and wherein the latch only returns to the unlocked position as the guider frame is substantially returned to the use position.

14. The folding elliptical exercise machine of claim 10, wherein the latch of the locking device has a hook, and each of the two catches has a notch configured to engage the hook and two curved chamfers which are positioned on either side of the notch.

* * * * *